US011297932B2

(12) United States Patent
Berhault et al.

(10) Patent No.: US 11,297,932 B2
(45) Date of Patent: Apr. 12, 2022

(54) DEVICE FOR PACKAGING AND APPLYING A COSMETIC PRODUCT

(71) Applicant: L'OREAL, Paris (FR)

(72) Inventors: Alain Berhault, Clichy (FR); Chloe Cabon, Clichy (FR)

(73) Assignee: L'OREAL, Paris (FR)

( * ) Notice: Subject to any disclaimer, the term of this patent is extended or adjusted under 35 U.S.C. 154(b) by 855 days.

(21) Appl. No.: 16/077,935

(22) PCT Filed: Feb. 14, 2017

(86) PCT No.: PCT/EP2017/053290
§ 371 (c)(1),
(2) Date: Aug. 14, 2018

(87) PCT Pub. No.: WO2017/140675
PCT Pub. Date: Aug. 24, 2017

(65) Prior Publication Data

US 2021/0186192 A1 Jun. 24, 2021

(30) Foreign Application Priority Data

Feb. 17, 2016 (FR) ..... 1651273

(51) Int. Cl.
*A45D 34/04* (2006.01)
*A45D 40/26* (2006.01)
(Continued)

(52) U.S. Cl.
CPC ..... *A46B 11/0013* (2013.01); *A45D 34/042* (2013.01); *A45D 40/262* (2013.01);
(Continued)

(58) Field of Classification Search
CPC .. A45D 34/042; A45D 34/043; A45D 34/045; A45D 34/046; A45D 40/262;
(Continued)

(56) References Cited

U.S. PATENT DOCUMENTS 4,101,225 A * 7/1978 Linz ..... A45D 34/04 401/119
5,492,426 A 2/1996 Gueret
(Continued)

FOREIGN PATENT DOCUMENTS

EP 0 612 488 A1 8/1994
FR 2 544 970 A1 11/1984
(Continued)

OTHER PUBLICATIONS

Third Party Observation dated Feb. 5, 2020 in Japanese patent Application No. 2018-543323, (with unedited computer generated English translation), citing document AO therein, 11 pages.
(Continued)

*Primary Examiner* — David J Walczak

(74) *Attorney, Agent, or Firm* — Oblon, McClelland, Maier & Neustadt, L.L.P.

(57) ABSTRACT

A device for packaging and applying a cosmetic product includes a brush applicator having a tuft of bristles at one end, and a container to which the brush applicator can be fastened, comprising a container intended to contain the product to be applied and a housing for receiving at least a part of the tuft of bristles of the brush, said housing communicating with the container via at least one opening, wherein, when the brush applicator is fastened to the container, only some of the bristles of the tuft of bristles are disposed in and/or next to the opening and directly exposed to the product coming from the container.

15 Claims, 1 Drawing Sheet

Figure 1:
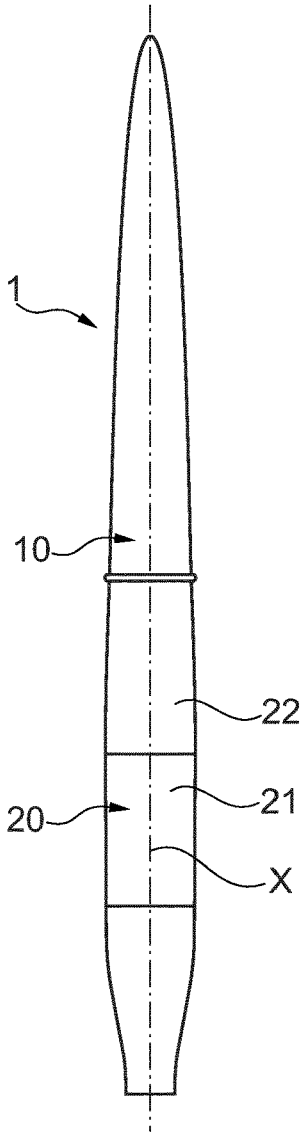

(51) Int. Cl.
*A46B 11/00* (2006.01)
*A46B 9/02* (2006.01)

(52) U.S. Cl.
CPC ..... *A46B 9/021* (2013.01); *A46B 11/0072* (2013.01); *A45D 34/045* (2013.01); *A45D 40/265* (2013.01); *A46B 2200/1046* (2013.01)

(58) Field of Classification Search
CPC .. A45D 40/264; A45D 40/265; A45D 40/267; A45D 2200/1072; A45D 2200/05; A46B 11/0013; A46B 9/021; A46B 11/0072; A46B 2200/1046
USPC ..... 401/121, 122, 126, 129
See application file for complete search history.

(56) References Cited

U.S. PATENT DOCUMENTS 5,720,563 A 2/1998 Nakagawa
5,890,828 A * 4/1999 Gueret ..... A45D 34/045 401/126
RE37,931 E 12/2002 Gueret
9,282,805 B2 * 3/2016 Stredak ..... A45D 40/262
2012/0132222 A1 5/2012 Gueret

FOREIGN PATENT DOCUMENTS

JP 63-82970 A 4/1988
JP 8-275819 A 10/1996
JP 2010-200923 A 9/2010
WO WO 2011/004341 A2 1/2011

OTHER PUBLICATIONS

Office Action dated Mar. 9, 2020 in corresponding Japanese Patent Application No. 2018-543323 (with English Translation), citing document AO therein, 8 pages.
International Search Report dated May 23, 2017 in PCT/EP2017/053290 filed Feb. 14, 2017.
French Preliminary Search Report dated Oct. 17, 2016 in French Application 1651273 filed Feb. 17, 2016.
Japanese Office Action dated Oct. 15, 2019, in Patent Application No. 2018-543323, citing document AO therein, 8 pages (with unedited computer generated English translation).

* cited by examiner

DEVICE FOR PACKAGING AND APPLYING A COSMETIC PRODUCT

The present invention relates to packaging and application devices comprising a brush applicator.

The application FR 2 544 970 discloses a device comprising a container to which a brush applicator is fastened when it is not in use. The container comprises a main container containing a makeup powder, said container communicating with an auxiliary chamber through which a frustoconical well passes. The latter extends at a distance from the bottom of the chamber and defines a housing for receiving the brush applicator. This housing communicates with the intermediate chamber via an opening defined by the lower end of the well. The brush applicator comprises a tuft of bristles which extends through the opening until it touches the bottom of the intermediate chamber.

When the brush applicator is in position on the container, the cross section of the tuft of bristles increases until it is at a maximum at the opening, and then decreases as far as its distal end.

Such a device makes it possible to limit the quantity of product with which the brush applicator is loaded in that the bundle of bristles is narrowed and only that part of the tuft of bristles that protrudes from the frustoconical well is exposed to the product. All of the bristles are exposed to the product at their ends.

However, it is relatively bulky and it can prove problematic to supply the auxiliary chamber with product once a certain degree of emptying has been reached, it being possible for this to result in a loss of product.

In addition, it remains difficult, with such a device, to produce a makeup result in which the deposition of product is blended gradually.

Therefore, the present invention aims to improve packaging and application devices that use a brush applicator, in order for it to be easily possible to produce a quality makeup result, preferably with a deposition of product having soft-focus contours.

The invention achieves this objective by virtue of a device for packaging and applying a cosmetic product, comprising:

- a brush applicator comprising a tuft of bristles at one end,
- a container to which the brush applicator can be fastened, comprising a container intended to contain the product to be applied and a housing for receiving at least a part of the tuft of bristles of the brush, said housing communicating with the container via at least one opening, wherein, when the brush applicator is fastened to the container, only some of the bristles of the tuft of bristles are disposed in and/or next to the opening and directly exposed to the product coming from the container.

The opening may be a single, preferably centered, opening. The density and shape of the tuft of bristles can ensure that the opening is closed off when the applicator is fastened to the container.

In a variant, the device preferably comprises several openings, each closed off by the tuft of bristles, for example opening out onto a tip side of the tuft of bristles of the brush applicator or onto a part of the application surface other than at the tip.

The expression "only some of the bristles" should be understood in numerical terms; in other words, if the total number of bristles is N, only n bristles, where $n<N$, are loaded with product by being directly exposed to the product through the opening.

The expression "directly exposed to the product" should be understood as meaning that the product can flow freely from the container to the end of the bristles that face the opening or are engaged therein.

The invention makes it possible to very easily load only some of the bristles of the brush with product, preferably in the central region thereof, and to have, around this central region, bristles that are loaded little, if at all, with product, these being useful for effectively blending the deposition of product carried out by the bristles loaded with product.

This makes it possible, if desired, to produce a makeup result with a soft-focus contour that is perfectly blended.

Preferably, when the brush applicator is in position on the container, the tuft of bristles has a cross section which decreases over a distance d1, measured along the longitudinal axis of the tuft of bristles, from a point at which the section is at a maximum as far as the distal end of the tuft of bristles, the housing and the tuft of bristles being arranged such that the tuft of bristles is exposed to the product contained in the container, from the distal end of the tuft of bristles, over a distance d2 that is strictly inferior to d1.

Preferably, the container is situated substantially in line with the brush applicator when the latter is fastened to the container. It is thus possible to reduce the diameter of the device and, if desired, give it the appearance of a pen, which is easy to store in a makeup bag.

Preferably, $d2/(d1-d2)<1/2$, better still $d2/(d1-d2)<1/3$, even better still $d2/(d1-d2)<1/4$.

Preferably, $n\leq 2/3\cdot N$, wherein N is the total number of bristles and n is the number of bristles directly exposed to the product. The brush housing may be funnel-shaped in order to constrain the bristles of the brush to be narrowed: in this case, the number of bristles exposed to the product can be greater than half the total number of bristles, even if some of the bristles remain protected and out of contact with the product. The container may be situated substantially in line with the brush applicator when the latter is fastened to the container.

The product may be pulverulent, liquid or semiliquid.

The container may comprise a hollow body that is open at one end and an insert attached to this body, the insert defining said housing.

The insert may comprise a mounting skirt to which the brush applicator is fastened.

The device according to the invention may have a wall that extends at a nonzero distance from the body of the container and defines said opening. This wall may define the bottom of the housing and converge toward the container.

A part of the tuft of bristles may be engaged in the abovementioned opening, preferably the tip thereof, if appropriate. The tuft of bristles is not engaged totally in the opening.

A part of the tuft of bristles may pass through the opening, preferably protruding therefrom.

The tuft of bristles is preferably in the shape of an ogive.

The ratio So/Sm between the section So of the opening and the maximum section Sm of the tuft of bristles when the applicator brush is fastened to the container is less than or equal to 1, better still less than or equal to ½, even better still less than or equal to ⅓, preferably less than or equal to ¼.

The tuft of bristles may come into contact with the wall defining the housing above the opening. It may come into contact with the wall defining the housing over a distance Z greater than or equal to L/4, where L denotes the visible length of the tuft of bristles.

The tuft of bristles may be constrained radially in the housing above the opening, preferably at a distance from the opening, measured along the longitudinal axis of the housing, that is greater than or equal to L/10, better still greater than or equal to L/5, even better still greater than or equal to L/4, where L denotes the visible length of the tuft of bristles. Narrowing and constraining the tuft of bristles will increase the density thereof and thus limit the rising up of product inside the tuft and the escape of product at the sides. The quantity of product on the tuft is thus controlled by the section given to the opening.

The container may comprise an agitation means for the product, preferably one or more balls which make it possible to move the product to the end of the brush by agitation of the assembly. The balls are coated with product and transfer it to the bristles.

It is possible for the agitation means not to have any homogenizing function when the product does not separate, this preferably being the case.

The present invention also relates to a method for loading a brush applicator as defined above with product, wherein the device is agitated axially with the brush applicator in position on the container so as to close it, and then the latter is held the right way up and the brush applicator is separated from the container.

The present invention also relates to a method for making up human keratin materials, wherein the brush applicator is loaded in accordance with the loading method defined above and then the product is applied using a surface of the tuft of bristles that is not loaded with product to spread the product and blend the product over the zone treated.

Figure 2:
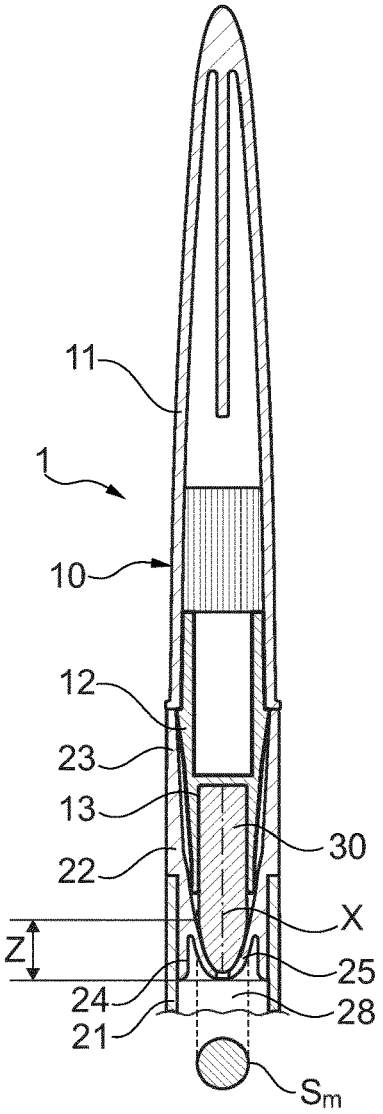
Figure 3:
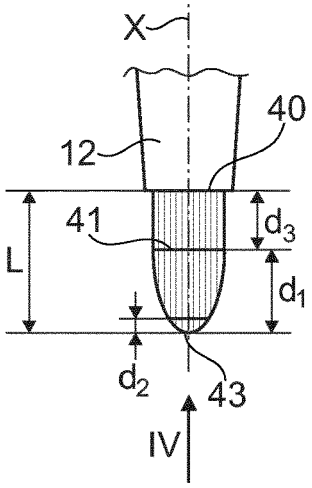
Figure 4:
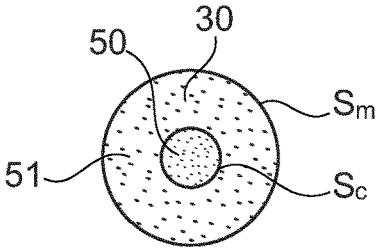
Figure 5:
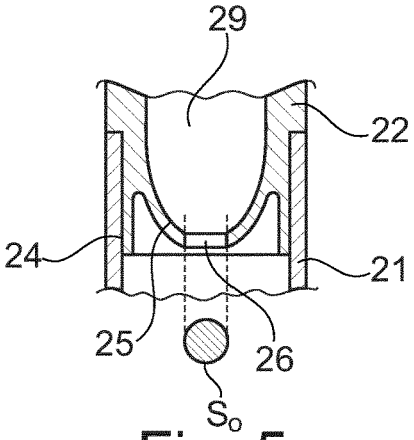

The invention may be understood better from reading the following detailed description of a nonlimiting illustrative embodiment thereof and from studying the appended drawing, in which:

FIG. 1 shows a schematic elevation view of an example of a packaging and application device according to the invention, FIG. 2 is a partial and schematic axial section through the device in FIG. 1, FIG. 3 shows the end, loaded with product, of the brush after the applicator has been withdrawn, FIG. 4 is a front view along the arrow IV in FIG. 3, and FIG. 5 shows the housing for receiving the brush, on its own and in part.

The packaging and application device 1 according to the invention that is shown in the figures comprises an applicator 10 and a container 20 to which the applicator 10 can be fastened when it is not in use, as illustrated in FIG. 1.

The container 20 contains a makeup product such as a foundation or an eyeshadow.

The applicator 10 comprises a handle 11 to which there is fastened an insert 12 that defines a housing 13 in which there is fixed a tuft of bristles 30 that extends axially along a longitudinal axis X. This axis is in this case coincident with the longitudinal axis of the applicator 10 and with the longitudinal axis of the container 20.

The tuft of bristles 30 can be fixed to the brush applicator by various means, for example by adhesive bonding, crimping, stapling, overmolding, pressing, among other possibilities. The bristles can preferably be welded so as to form a collar of melted plastic at the base of the tuft. The tuft is then joined to a cap by mechanical clamping. Furthermore, depending on the assembly method, the bristles can be inserted from the front of the brush or from the rear of the brush. An advantage of assembly from the rear is that it allows an even better increase in the density of the tuft of bristles by a funnel effect.

The bristles are natural or synthetic. The bristles may be constituted of at least one synthetic material, for example chosen from the following list: PA 6,12, polyester, Rilsan®, polyamide, polyether, polyamide block-ether, polyethylene, polytetrafluoroethylene, polyvinylidene fluoride, polyacetate, polyethylene terephthalate, Natrafil®, Hytrel®.

Their section can be circular, polygonal, oval or multilobe and their section can be solid or hollow.

The tuft of bristles 30 can comprise a single type of bristles or a mixture of bristles of different kinds.

The container 20 comprises a body 21 to which an insert 22 is fastened which defines the neck 23 of the container, in which the applicator brush is fitted when the container is closed, as illustrated in FIG. 2. The insert 22 comprises an annular sealing lip 24 which is pressed against the inner wall of the body 21, and a lip 25 that defines an opening 26 via which the internal space 28 of the container containing the product communicates with a housing 29 for receiving the tuft of bristles, defined by the insert 22 above the lip 25. The internal space 28 can also contain one or more mixing members, such as metal balls, for moving the product under the end of the brush by agitation of the assembly and also, if appropriate, for homogenizing the product contained in the space 28 before use.

When the applicator 10 is withdrawn from the container, the tuft of bristles 30 has an ogival shape with a total visible length L. The cross section of the tuft of bristles 30 is for example constant over a distance d3 between the distal end 40 of the insert 12 and a section 41 from which the cross section of the brush decreases as far as its free end 43, as can be seen in FIG. 3. The cross section of the brush decreases over a distance d1 that is inferior to L in the example in question. In a variant that is not illustrated, the section decreases along the entire length L. The section of the tuft of bristles 30 may be circular or not, for example oval or polygonal.

In accordance with the invention, the housing 29 in which the tuft of bristles 30 is received is produced such that only a part of the tuft of bristles 30 is exposed to the product contained in the space 28 when the container is shaken, so as to load the tuft of bristles 30 inhomogeneously with product. More particularly, the housing 29 is produced such that the tuft of bristles is loaded with product over a height d2 strictly inferior to d1, as illustrated in FIG. 3. When the brush applicator is in position on the container, the tuft of bristles 30 is engaged in the housing 29 and bears against the lip 25 such that only the end part of the tuft of bristles is engaged in the opening 26 and is thus directly exposed to the product in order to be loaded with a dash of product there.

The ratio So/Sm between the section So of the opening and the maximum section Sm of the tuft of bristles 30 when the applicator brush is fastened to the container may be less than or equal to 1, better still less than or equal to ½, even better still less than or equal to ⅓, preferably less than or equal to ¼.

The tuft of bristles 30 can come into contact with the wall and define the housing over a distance Z greater than or equal to L/4, where L denotes the visible length of the tuft of bristles.

The tuft of bristles 30 can be constrained radially in the housing 29 above the opening 26, preferably at a distance from the opening, measured along the longitudinal axis of the housing, that is greater than or equal to L/4, where L denotes the visible length of the tuft of bristles.

When the brush applicator is withdrawn from the container, the zone 50 loaded with product is thus situated at the center of the tuft of bristles 30 and takes up, in front view, a section So less than the maximum section Sm of the tuft of bristles 30, as can be seen in FIG. 4. This makes it possible to use the brush applicator to apply product in spots by virtue of the tip being well loaded with product, and then to use the bristles in the region 51 surrounding the end region 50 to blend the product and thus produce attractive shadings affording a soft-focus effect that makes it possible to reduce the visibility of the contour between the region to which the product has been applied and the surrounding skin.

Of course, the invention is not limited to the example which has just been described.

For example, it is possible to further modify the shape of the tuft of bristles of the brush applicator, for example to provide a tuft of bristles which is frustoconical toward its free end, hemispherical, with a single bevel or with a double bevel.

It is also possible to modify the position of the opening relative to the tuft of bristles in order to impregnate a different zone than the end of the tuft.

The product contained in the container is preferably pulverulent, and preferably is a dry powder. In a variant, the product has a liquid to semiliquid consistency. The product may contain a dispersion of pigments and/or fillers in an aqueous medium.

In variants, the tuft of bristles has a beveled shape. Preferably in this case, the opening can be offset slightly to the side of the end of the bevel.

The invention claimed is:

1. A device for packaging and applying a cosmetic product, comprising:

a brush applicator comprising a tuft of bristles at one end; and a container to which the brush applicator can be fastened, comprising an internal space intended to contain the product to be applied and a housing for receiving at least a part of the tuft of bristles of the brush applicator, said housing communicating with the internal space via at least one opening, wherein, when the brush applicator is fastened to the container, only some of the bristles of the tuft of bristles are disposed in or next to the opening and directly exposed to the product coming from the internal space, a ratio So/Sm between a section So of the opening and a maximum section Sm of the tuft of bristles when the applicator brush is fastened to the container is less than or equal to ¼.

2. The device as claimed in claim 1, wherein the tuft of bristles is engaged in the opening and closes the opening off when the applicator is fastened to the container.

3. The device as claimed in claim 1, wherein, when the brush applicator is fastened to the container, the tuft of bristles has a cross section which decreases over a distance d1, measured along a longitudinal axis of the tuft of bristles, from a point at which the section is at a maximum as far as a distal end of the tuft of bristles, the housing and the tuft of bristles being arranged such that the tuft of bristles is exposed to the product contained in the internal space, from the distal end of the tuft of bristles, over a distance d2 that is less than d1.

4. The device as claimed in claim 3, wherein $d2/(d1-d2) < 1/2$.

5. The device as claimed in claim 1, wherein the container has a hollow body that is open at one end and an insert attached to this body, the insert defining said housing.

6. The device as claimed in claim 5, wherein the insert comprises a mounting skirt to which the brush applicator is fastened.

7. The device as claimed in claim 5, the device has a wall that extends at a nonzero distance from the body of the container and defines said opening.

8. The device as claimed in claim 1, wherein a tip of the tuft of bristles is engaged in the opening.

9. The device as claimed in claim 1, wherein part of the tuft of bristles passes through the opening.

10. The device as claimed in claim 1, wherein the tuft of bristles comes into contact with a wall defining the housing above the opening.

11. The device as claimed in claim 10, wherein the tuft of bristles comes into contact with the wall defining the housing over a distance greater than or equal to L/4, where L denotes the visible length of the tuft of bristles.

12. The device as claimed in claim 1, wherein the tuft of bristles is constrained radially in the housing above the opening.

13. The device as claimed in claim 1, wherein the container comprises an agitation means for the product.

14. A method for loading a brush applicator as defined in claim 1 with product, wherein the device is agitated axially with the brush applicator in position on the container so as to close the container, and then the container is held the right way up and the brush applicator is separated from the container.

15. A method for making up human keratin materials, wherein the brush applicator is loaded in accordance with the loading method defined in claim 14 and then the product is applied using a surface of the tuft of bristles that is not loaded with product to spread the product and blend the product over the zone treated.

* * * * *